US006681090B2

(12) United States Patent
Cornelius

(10) Patent No.: US 6,681,090 B2
(45) Date of Patent: Jan. 20, 2004

(54) EP PRINT MEDIA PATH ACTUATED BY INSERTION/REMOVAL OF TONER CARTRIDGE

(75) Inventor: William Leonard Cornelius, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/075,785

(22) Filed: Feb. 13, 2002

(65) Prior Publication Data

US 2003/0152401 A1 Aug. 14, 2003

(51) Int. Cl.[7] ..... G03G 15/16; G03G 15/20
(52) U.S. Cl. ..... 399/122; 399/124
(58) Field of Search ..... 399/21, 122, 124, 399/125, 110, 111, 107, 328, 388

(56) References Cited

U.S. PATENT DOCUMENTS

| | | | | | |
|---|---|---|---|---|---|
| 4,428,660 | A | * | 1/1984 | Matsumoto | 399/122 |
| 4,589,758 | A | * | 5/1986 | Kasama et al. | 399/122 |
| 4,835,567 | A | * | 5/1989 | Ogata | 399/124 |
| 5,105,228 | A | * | 4/1992 | Kato | 399/122 |
| 5,300,998 | A | * | 4/1994 | Ogisawa et al. | 399/124 |
| 5,379,092 | A | * | 1/1995 | Takashima | 399/125 |
| 5,737,681 | A | * | 4/1998 | Hyakutake et al. | 399/388 |
| 5,768,659 | A | * | 6/1998 | Kameda | 399/111 |

* cited by examiner

*Primary Examiner*—Sandra Brase

(57) ABSTRACT

An electrophotographic printer is provided with a toner cartridge that is inserted/removed from said printer via its top side. The insertion and removal of the toner cartridge sets/releases the pressure on fuser rollers in order to facilitate clearing print media jams in the printer's fuser region.

19 Claims, 5 Drawing Sheets

70
39
30A
30
49
30B
24
67
66
53
32B
54
32A
61
52
64
60
64

EP PRINT MEDIA PATH ACTUATED BY INSERTION/REMOVAL OF TONER CARTRIDGE

BACKGROUND OF THE INVENTION

Field of the Invention

The present invention generally relates to electrophotographic printers (EPs). More particularly, it relates to those devices and procedures used to access print media (e.g., a sheet of paper) that becomes jammed in the fuser roller units of such EPs. Such jams have become more and more troublesome with current trends toward smaller and smaller EP footprints and shorter heights. These trends have placed a premium on the available space within such printers—especially in the area between their laser printers and fuser units.

EP fuser units usually have two rollers that rotate in pressured, rolling contact with each other. At least one of these two rollers is internally heated by an electrical heater element or a halogen tube. The nonheated roller, or so-called backup roller, is usually the powered roller. It is pressured against the heated roller in order to form a rolling, pressured interface through which print media passes in order to fuse a given toner image to a given sheet. Roller interface pressures between about 10 psi and about 100 psi are normally created between the heated roller and the backup roller.

Unfortunately, one or more sheets of print media sometimes become jammed in and around these fuser units. Consequently, the fuser area must be made accessible to human reach in order to clear such jams. This access is usually gained by doors or panels that are placed in the rear or sides of an EP housing. Access to the fuser area via the rear of such printers is, however, often hampered by the fact that such printers are placed against a wall in order to more fully utilize available work space. Such positioning (near a wall) of a large, heavy EP does not allow for easy access to its rear access door—and hence to its fuser area. Therefore, when a print media jam occurs in an EP unit whose rear is located near a wall, the entire EP unit must be moved in order to open a rear access door.

Once such access is gained, it is advantageous, if not necessary, that the fuser roller pressure on any jammed sheet(s) be relieved in order to facilitate hand removal of such sheet(s). If a jammed sheet is completely wrapped around a fuser roller, release of the fuser roller pressure may be mandatory. Known devices for releasing the pressure between two fuser rollers include providing the fuser roller mechanism with one or more human hand operated pressure release levers. These levers are generally located in the area exposed by opening a rear access door. Indeed, some fuser roller pressure release levers are activated by the act of opening such access doors. In any case, activation of these pressure release levers reduces the grip of the fuser rollers on jammed media and thereby facilitating its removal from a fuser. Use of access door actuated lever systems requires that the access door be reinforced in order to carry the extra load required to release and subsequently reset the fuser roller pressure via automatic actuation of release levers that mechanically cooperate with an access door. Such automatic roller pressure release systems also are mechanically complex and space consuming e.g., long and complex actuating levers are often employed.

Other jam clearing devices include mechanisms for freewheeling the fuser rollers in the process flow direction during jam conditions by automatically disengaging the fuser drive when print media becomes jammed in the fuser. Hand operated jam clearance knobs also have been used to turn the fuser rollers and thereby expel jammed sheets of media from a fuser unit without having to relieve the roller pressure.

Other EPs provide access to the fuser area via access doors in the sides of said printers. Unfortunately, this arrangement suffers from several drawbacks. For example, there is very little room for a human hand to move about in the narrow space between an EP's laser printer and its fuser unit when this space is accessed from the side. These conditions also lead to a tendency to pull on a jammed sheet from its side—and thereby tearing it. Such tearing sometimes leaves a sheet remnant jammed in the fuser. There is also a certain degree of danger associated with the fact that the cramped hand space that is exposed by side access doors is usually in close proximity to still hot heater rollers.

Jam clearing operations also are hindered by the fact that many EP users do not know how to carry out the approved fuser access and/or pressure release procedures. Other users may not have enough working space to readily turn the entire EP unit around in order to properly access a rear access door. Consequently, many user's first course of action in clearing a jam in the fuser area is to open the EP's toner cartridge loading/unloading door—which is usually located in the side of the EP housing—and thereby gaining relatively easy, but limited, access to one or more sheets of print media that are jammed in the fuser area. This course of action is often somewhat aided by the fact that, when an EP's toner cartridge is removed, the trailing edge of a jammed sheet of media is, to some degree, accessible to human reach. Again however, there is very little working room in the space between most EP's laser scanners and their fuser units. Moreover, because the fuser release levers are not necessarily releasable from the toner cartridge loading/unloading area, the fuser rollers may maintain their strong grip on one or more sheets of jammed print media. Under these circumstances, a user often tears off the rear end of a sheet that is jammed between the two, still pressured, fuser rollers. Additionally, when one or more sheets of print media is (are) partially wrapped around a fuser roller, or accordioned within the fuser unit, the leading edge(s) is (are) often not even visible from the toner cartridge side of the fuser. Here again, there also is some danger associated with touching a hot fuser unit when attempting to remove a sheet remnant that is wrapped around a fuser roller in general, and a still pressured fuser roller in particular.

If the rear end of a jammed sheet is torn off, the only remaining practical way of removing the remainder of that torn sheet is by opening its rear access door. Again, when the rear of the EP is near a wall, the entire EP will have to be turned about. After this moving operation is completed, the fuser pressure can be released and the jammed paper cleared. It is, however, also possible that sheet fragments created by tearing a sheet from the other side of the fuser cannot be seen and/or readily removed via the rear access door. In which case, either the printer must be sent to an outside repair facility, or a service agent must be sent to make extensive on-site repairs. Obviously, avoiding or minimizing these measures has great practical and economic value.

SUMMARY OF THE INVENTION

Applicant has found that a more effective print media jam clearance method is to expose the fuser roller area from above. This is done by removal of a toner cartridge that is generally located above the fuser region. In effect, the toner cartridge is removed via the top of the EP unit rather than via its side. Removal of the toner cartridge from the fuser area via the top of the EP allows wide ranging, two-handed, access to that region and thereby allowing jammed media to be more effectively extricated from the fuser area.

This method of clearing a media jam also involves action of a fuser roller pressure release mechanism. Such a pressure release mechanism is automatically deactuated by removal of the toner cartridge from the EP. That is to say removal of the toner cartridge automatically relieves the pressure between the fuser's two rollers. To this end, at least one of the fuser rollers is held in a pressure releasable journal in which a fuser roller axle rotates. Preferably, the drive roller (rather than the heater roller) is provided with such a pressure release journal. Conversely, reinsertion of the toner cartridge back into the EP causes the fuser roller pressure mechanism to be actuated so that the fuser roller pressure is reapplied. A preferred mechanism for activating and deactivating the roller pressure will employ a spring loaded lever arm that engages with, and disengages from, a leading part of the toner cartridge as it is inserted into/removed from the EP. Such activation and deactivation of the fuser roller pressure by insertion/removal of the toner cartridge may also be accompanied by other changes in the EP's print media path hereinafter more fully described.

The toner cartridge removal methods (i.e., via the top of the printer) and pressure release devices of this patent disclosure: (1) provide automatic release of the fuser roller pressure when the toner cartridge is removed, (2) provide more room to grasp jammed media, (3) decrease the risk of tearing the media while trying to remove it, (4) decrease the risk of inadvertently touching a hot fuser roller and (5) simplify removal of wrap/accordion type jams in a fuser.

DETAILED DESCRIPTION OF THE INVENTION

Figure 1:
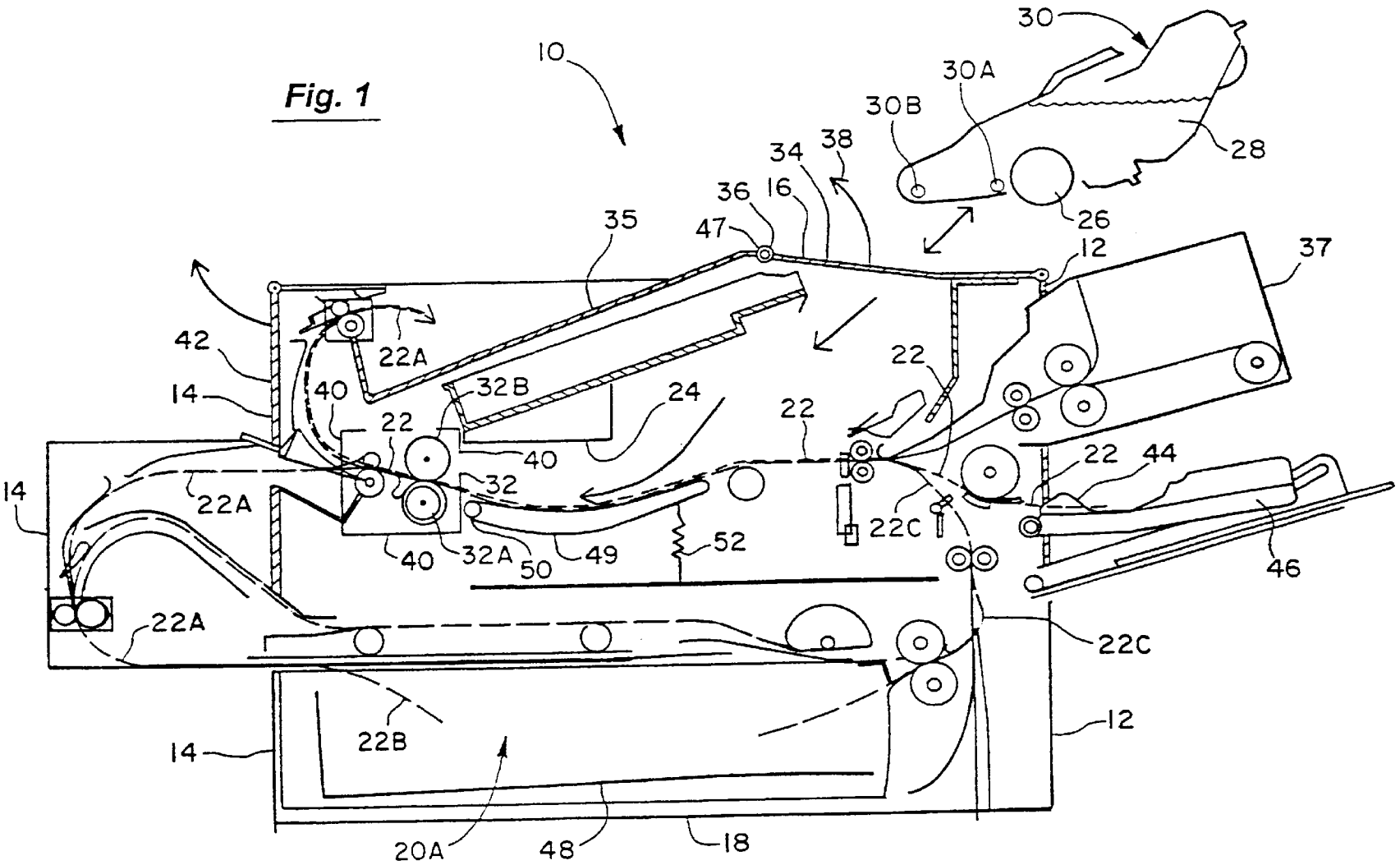
FIG. 1 is a cut-away side view of an EP unit made according to the teachings of this patent disclosure wherein its toner cartridge is shown removed from the EP unit via the top of said EP.

FIG. 1 depicts applicant's electrophotographic printer (EP) having a front 12, rear 14, top 16, bottom 18 and side 20A (see side 20B in FIG. 2) and having a print media path 22 that passes under a laser printer 24, and a toner transfer mechanism 26 supplied with toner 28 by a toner cartridge 30. In some preferred embodiments of this invention, the toner transfer mechanism 26 can be a part of the removable toner cartridge 30.

The EP 10 also has a toner fuser 32. This toner fuser 32 has two rollers 32A and 32B that are capable of making pressured, rolling contact with each other and defining a nip through which a sheet of print media is drawn. Preferably, the fuser roller operating pressure will be from about 10 psi to about 100 psi. The EP 10 of FIG. 1 also is shown provided with a toner access door 34 in the top 16 of the EP 10. The front end 36 of the toner access door 34 is preferably pivotally mounted to the top 16 of the EP 10. The top surface of this top access panel 34 may (but need not) also form a part of the sheet collection tray 35. Be that as it may, such toner access door 34 is preferably capable of a pivotal motion such as that generally depicted by arrow 38. That is to say that pivoting the toner access door 34 in the manner suggested by arrow 38 (see also FIG. 2) exposes the toner cartridge 30 so that it can be removed via the top 16 of the EP 10. Access to the general area 40 of the EP's fuser 32 also may be gaining through a second access door 42 that is preferably located in the upper region of the rear 14 of the EP 10.

The general media path 22 through the EP 10 depicted in FIG. 1 may vary according to whether or not the toner cartridge 30 is inserted into or removed from its operating position within the EP 10. The media path 22 also can vary according to the printing function being carried out. One such printing function will involve picking up a given sheet of print media 44 such as a sheet of paper from a feed tray 46 and sending it over a first media path 22A that eventually delivers the sheet to print media collection tray 35. This first media path 22A is provided with those mechanical devices (e.g., rollers, guides, etc., not shown) normally used to carry a given type of print media (paper, transparency, etc.) through an EP 10. Again, in one of the more preferred embodiments of this invention, such a print media collection tray 35 forms a part of the top surface 16 of the EP 10 (it also may form a part of the toner access door 34). Print media that travels over this first media path 22A would carry out a simplex printing operation whereby a given sheet of print media 44 receives printing on only one of its two sides.

Conversely, a given sheet of print media may be directed over a second or alternative media path 22B whereby a given sheet 44 receives printing on both sides in a duplex printing operation. This second printing path 22B turns the sheet over and delivers it to a duplexing tray 48. After a given stack of print media is delivered to the duplexing tray 48, the sheets are individually removed from a stack of such sheets residing in the duplexing tray 48 and sent over a third media path 22C. This third media path 22C leads into a part of the media path 22 that is generally located in front of the feed tray 46. Hence, the turned-over sheet can receive printing on its second side. Thereafter, it is sent to the print media collection tray 35. Such an EP 10 also may be supplied with other print media feed handling features such as the envelope feeding tray 37 shown on its upper front side 12.

In an optional embodiment of this invention, a paper guide 49, that is generally located in the media path 22A immediately upstream from fuser 32, pivots about some point e.g., pivot point 50, that is convenient to the printer's architecture. In this embodiment, the pivot point 50 is preferably located at a point near the feed side of the fuser 32. This paper guide 49 functions in a first manner when the toner cartridge 30 is removed from the EP 10. It then functions in a second manner when the toner cartridge 30 is inserted back into the EP 10 (see FIG. 5).

Figure 5:
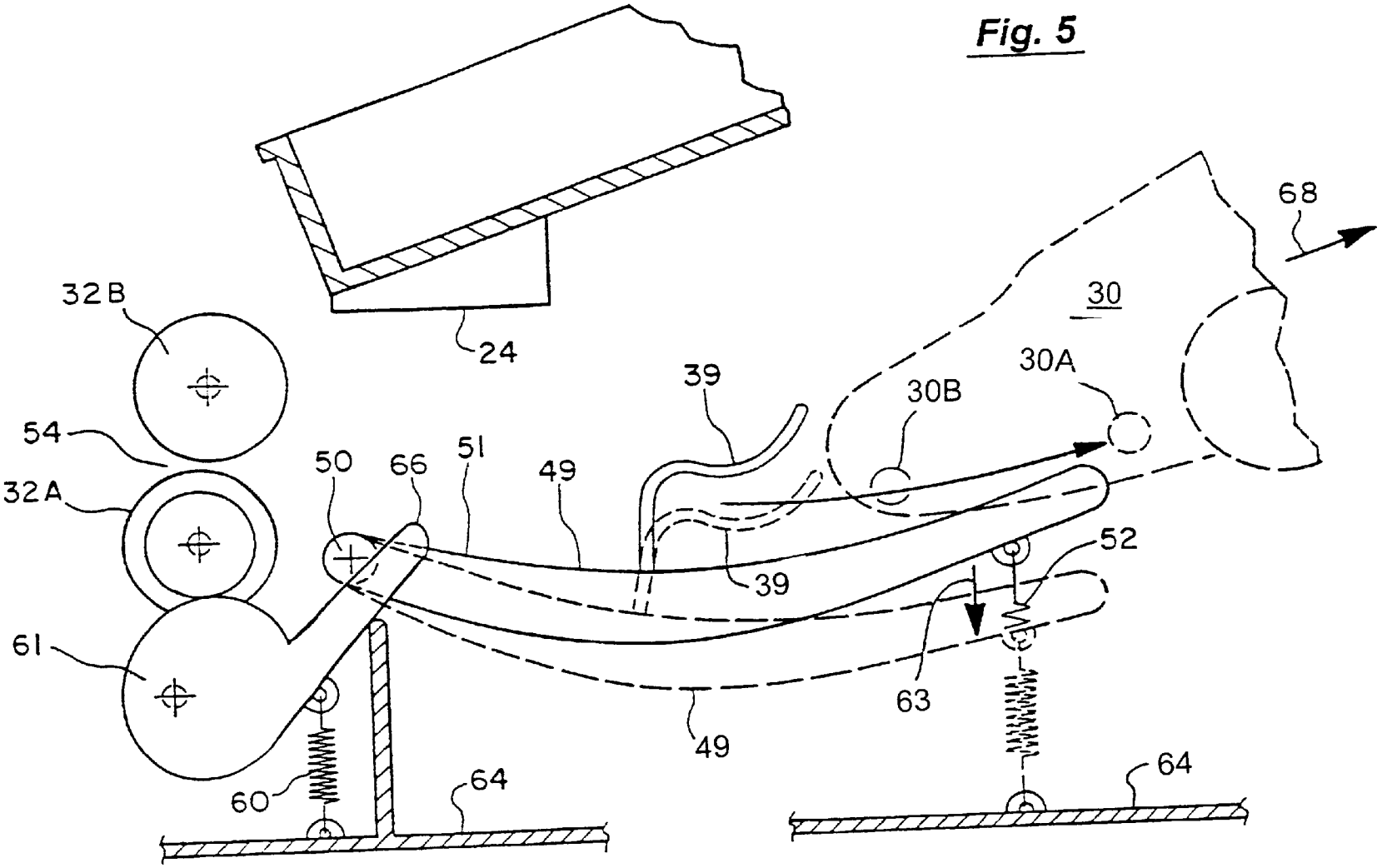
FIG. 5 is a side view of the operation of a paper guide that can be used in the EP.

For example, a spring 52 such as that shown in FIGS. 1 and 5 could be attached to the underside of the paper guide 49 to insure that the guide remains downward (and hence out of the way of hand movements) when the toner cartridge is removed. However, to prevent problems resulting from the paper guide 49 (and hence the media path 22) being out of its sheet guiding position when the EP is printing, said guide also could be locked in an upward, sheet guiding, position when the cartridge 30 is installed. In one particularly preferred embodiment of this invention, such an upward position of the paper guide 49 can be brought about by insertion of the toner cartridge 30 into the EP 10, e.g., in the manner generally depicted in FIG. 6.

Such a paper guide 49 also preferably has an upwardly ramped or inclined surface 51 that leads into the fuser nip 53. Thus, when the toner cartridge 30 is fully inserted, the left or fuser side of the ramped paper guide 49 is forced into a position that directs the print media traveling over print media path 22 into the fuser 32. Conversely, when the toner cartridge 30 is removed from the EP 10, the right end of the pivoting paper guide 49 would automatically be pulled down in the manner suggested in FIG. 5, and thereby possibly expose a trailing portion of a sheet that is jammed in the fuser 32. In any case movement of the paper guide 49 downward when the cartridge 30 is removed from the EP provides more room for the user to grasp (even with both hands) the rear of a sheet of print media that may be jammed in the fuser area 40.

Figure 2:
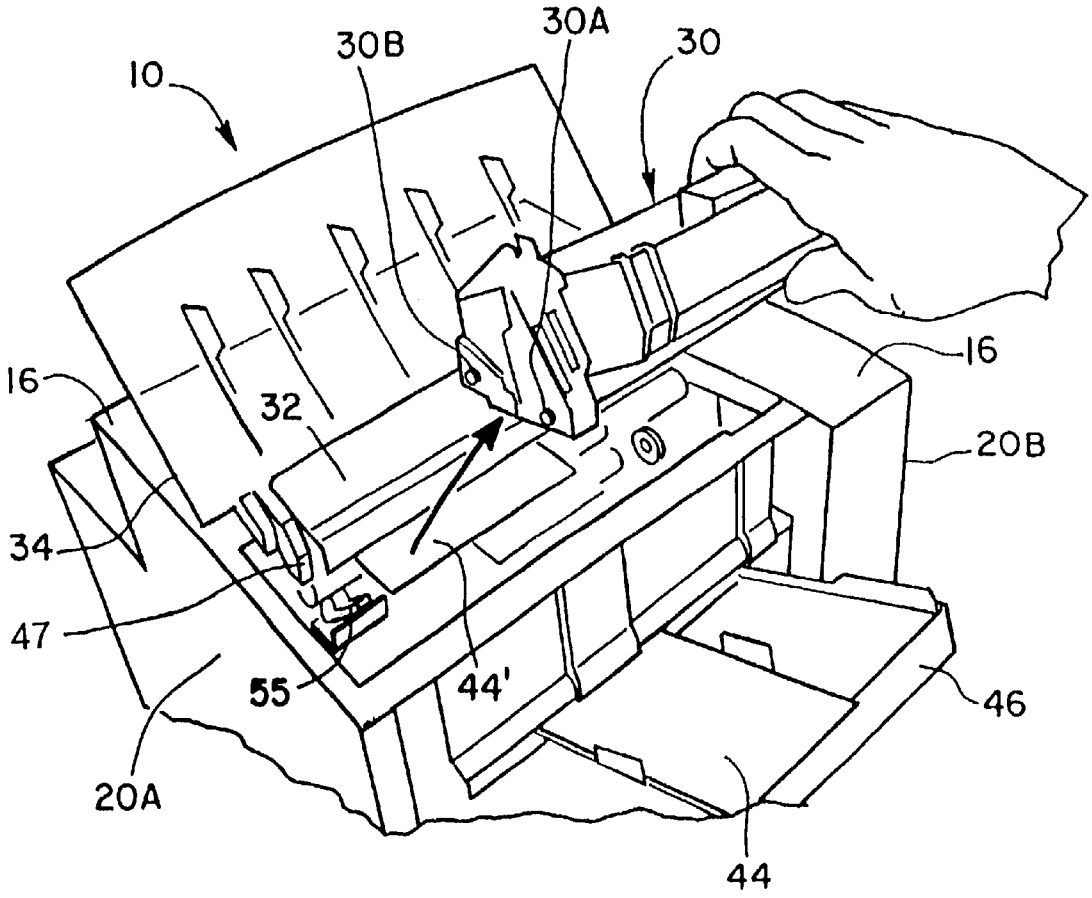
FIG. 2 is a top perspective view of a toner cartridge being removed via the top of the EP of FIG. 1.

FIG. 2 is a top perspective view of the EP 10 shown in FIG. 1. In this view, the toner access door 34 in the top 16 of the EP 10 has been pivoted forward about a pivot device 47. This exposes the insides of the top region of the EP 10. Preferably, the top of the toner cartridge 30 can be easily gripped by the operator and removed in the manner generally suggested in FIG. 2. The toner cartridge 30 will be provided with one or more holding and/or latching devices 30A and 30B known to those skilled in this art for holding the toner cartridge 30 in place within the body of the EP 10 when said EP 10 is in its printing mode. In another preferred embodiment of this invention, one such engaging device (e.g., 32A) is used to raise the paper guide 49 to a raised operating position such as those shown in FIGS. 5 and 6. In any case, after the toner cartridge 30 is removed, a trailing edge (e.g., trailing edge 44') of a sheet of paper jammed in the fuser 32 is very often fully accessible to the operator, especially after the paper guide 49 is pulled (by spring 52 in the manner suggested in FIG. 5) into a lower position and thereby exposing the nip 53 region of the fuser 32 to human reach.

Again, removing the toner cartridge 30 in the manner generally suggested in FIG. 2 will preferably cause an automatic release of the fuser roller pressure. That is to say that the act of removing the toner cartridge 30 from the EP 10 preferably causes a pressure release mechanism 54 such as that depicted in FIGS. 3 and 4 to be actuated to a position such that the pressure between the two fuser rollers 32A and 32B is released. A representative mechanism for causing this pressure release can employ a lever arm 55 such as that shown in greater detail in FIGS. 3 and 4.

Figure 3:
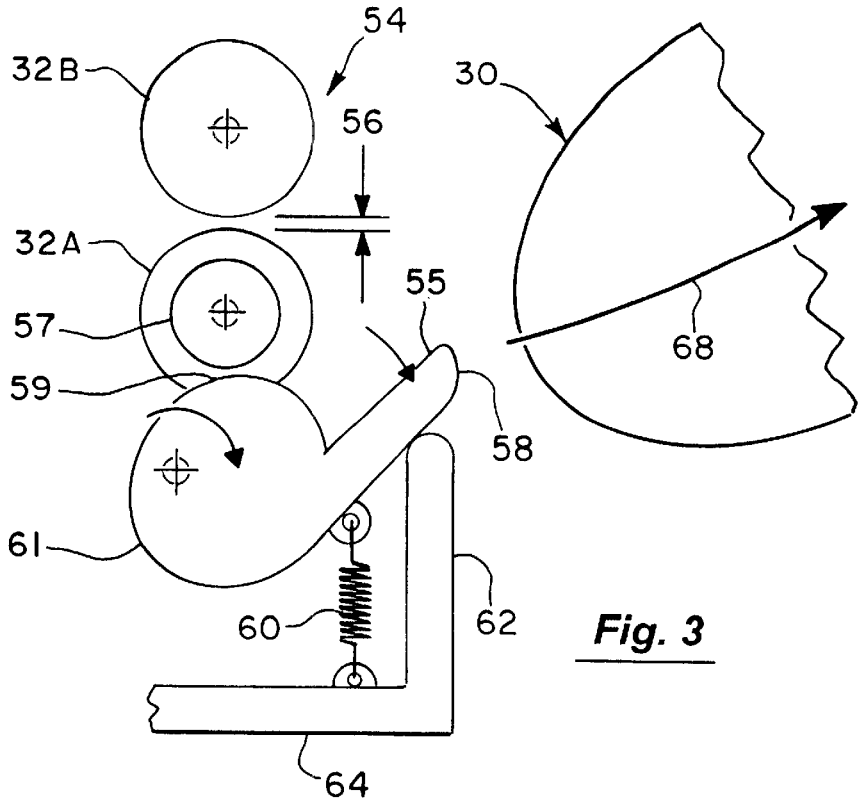
FIG. 3 is a side view of a representative lever arm mechanism for activating/deactivating the EP's fuser roller pressure. In this view the fuser rollers are shown in their unpressured mode.

FIG. 3 shows such a representative pressure release mechanism 54 wherein fuser rollers 32A and 32B are released from pressured contact with each other. This unpressured state is depicted by the existence of a gap 56 between rollers 32A and 32B. In this position, the fuser release lever arm 55 is, preferably, in a lowered position 58. This pressure release can be brought about in ways known to those skilled in this art. For example, lever arm 55 can be capable of causing mechanical pressure on a journal 57 in which an axle of a roller (e.g., roller 32A) resides in order that said roller is capable of rotation in said journal. That is to say, when the lever arm 55 is in its lowered position 58, a gap 56 is created between a roller journal 57 and the top surface 59 of a cam 61 to which the lever arm 55 is attached. Thus, the gap 56 between the fuser rollers 32A and 32B exists by virtue of the fact that a roller-carrying journal 57 on fuser roller 32A is out of camming contact with the top surface 59 of the cam 61. Thus, creation of gap 56 allows easy removal of print media caught between the fuser rollers 32A and 32B. Those skilled in this art will appreciate that the pressure delivered by the top surface 59 of the cam 61 need not be delivered directly to the journal—but rather can be delivered to a mechanical element (not shown) that is in mechanical or servomechanical linkage, connection or the like with a journal that actually carries a roller axle.

In any case, a pressure release mode is preferably brought about by lowering the lever arm 55 to a lower operating position 58 (in a less preferred, but still viable, embodiment of this invention, a roller pressure release could be achieved by raising the lever arm 55). The pressure release depicted in FIG. 3 is brought about by means of a lever arm biasing mechanism 60 such as a spring that pulls the lever arm 55 downward when the toner cartridge 30 is removed from the printer in the manner suggested by direction arrow 68. The lowered operating position 58 of the lever arm 55 can be more exactly defined by an upwardly directed abutment piece 62 that limits the downward motion of the lever arm 55 when said lever arm is pulled downward by the biasing device 60. Such a biasing device 60 can be attached to some fixed component 64 of the EP 10 frame (not otherwise shown).

Figure 4:
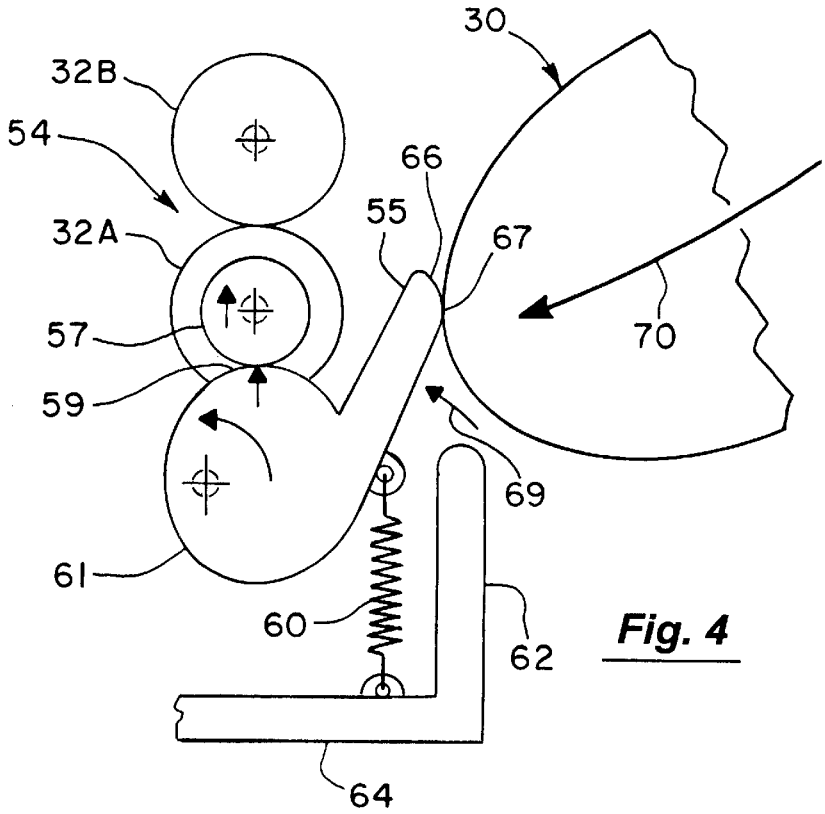
FIG. 4 is a side view of the lever arm mechanism of FIG. 3, but wherein the fuser rollers are shown in their pressured mode.

FIG. 4 shows the pressure release mechanism 54 when the fuser rollers 32A and 32B are compressed against each other. The fuser release lever 55 is in its upward position 66. This upward position 66 of the lever arm 55 is brought about by virtue of the fact that the front 67 of the toner cartridge 30 being forced into the EP 10 in the manner generally suggested by direction arrow 70 and thereby driving the lever arm 55 upward in the manner suggested by direction arrow 69. In this upward position, the force of the biasing device 60 has been overcome by an upward component of the force of incoming toner cartridge 30. Holding or locking mechanisms such as those depicted as item 30B in FIG. 3 can be used to hold the toner cartridge 30 in its intended operating position within the EP 10.

Thus, pressure from the toner cartridge 30 causes the fuser rollers 32A and 32B to be forced into a pressured, rolling contact. That is to say that, when the cartridge 30 is inserted in the manner depicted in FIG. 4, the top surface 59 of the cam 61 (to which the lever arm 55 is attached) is forced into camming contact with the journal 57 that carries fuser roller 32A. Thus, the rollers 32A and 32B are forced into pressured rolling contact with each other.

FIG. 5 depicts the paper guide 49 in its upward position and in its downward position. The paper guide is shown provided with a paper guide lifter 39 whose function is more fully described in FIG. 6. The downward position of the paper guide 49 is brought about when the toner cartridge 30 is removed and thereby allowing the spring 52 to pull the right end of the paper guide 49 in the downward direction generally suggested by direction arrow 63. This action brings the paper guide 49 to a lower position generally suggested by the phantom line depiction of the paper guide 49 wherein like elements are labeled with prime marks (e.g., paper guide 49 becomes paper guide 49' and so on). In effect this lowered position allows more room for a human hand to operate in clearing a media jam.

Figure 6:
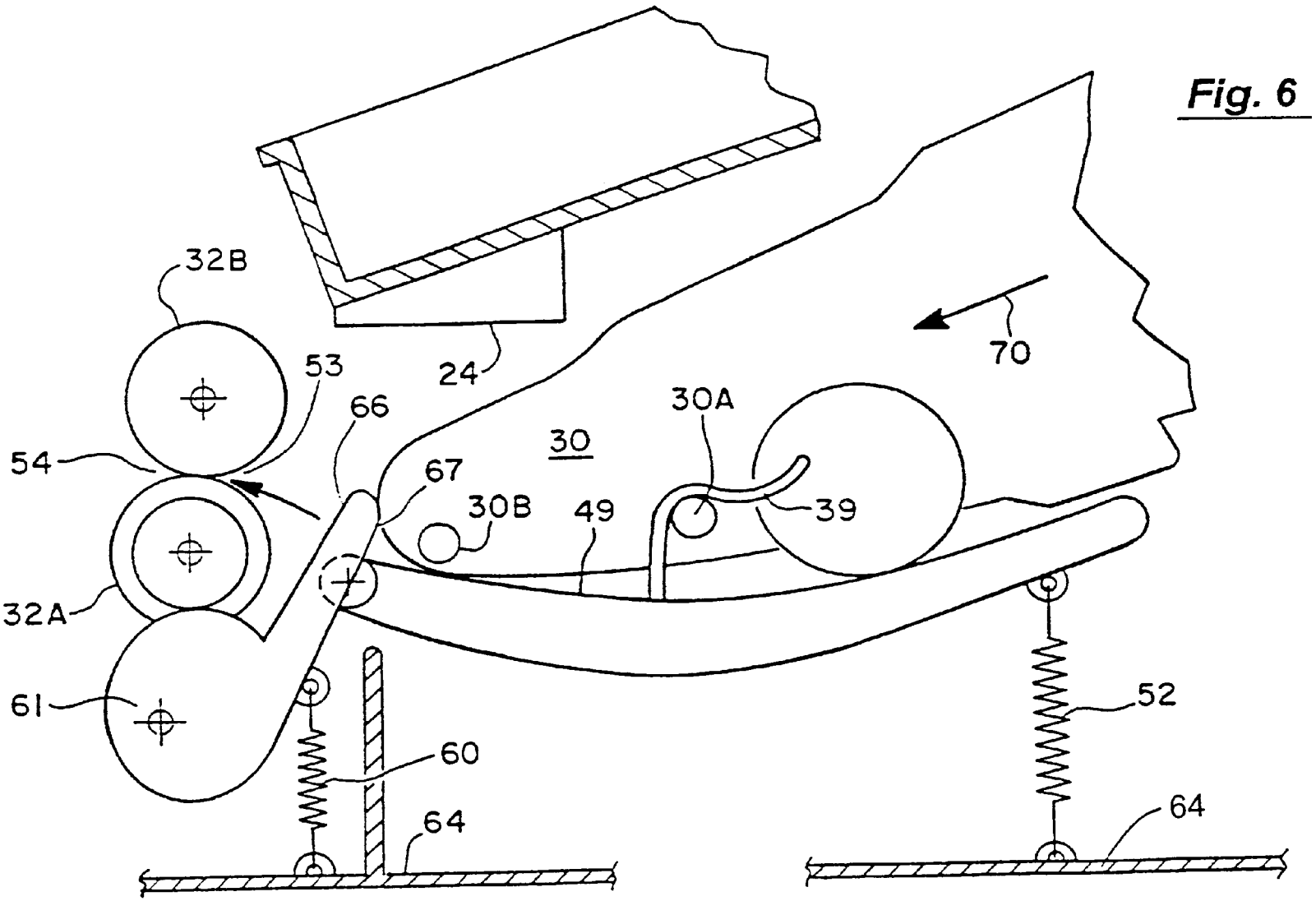
FIG. 6 is a side view of an embodiment of the EP wherein the toner cartridge mechanically cooperates with the paper guide shown in FIG. 5.

FIG. 6 depicts the paper guide 49 in its upward position. Preferably, this upward position is brought about by virtue of the fact that an engagement device such as an engagement pin 30A that projects from the toner cartridge (see also FIG. 2) has slid under a paper guide lifter 39. Preferably such a paper guide lifter 39 has a curved configuration that serves to guide the incoming engagement pin 30A into an operating position that serves to lift the paper guide 49 into its upward, sheet guiding, position. That is to say that, since the guide lifter 39 is securely attached to (or a part of) the paper guide 49, said guide 49 is lifted upward in the manner depicted in FIG. 6 when the toner cartridge 30 is inserted into the EP 10. In effect, the upward force created by cooperation of the engagement pin 30A and the guide lifter 39 overcomes the force created by the spring 52. FIG. 6 also depicts how, when the toner cartridge 30 is in its fully inserted position, a leading surface 67 of said cartridge 30 also forces the lever arm 55 on the pressure release mechanism 54 into its full upward position 66 and thereby creates pressured rolling contact between fuser rollers 32A and 32B (see also FIG. 4).

While this invention has been described with respect to various specific examples, and a spirit which is committed to the concept of accessing the fuser region of an EP via the top of said EP, it is to be understood that the herein described invention should be limited in scope only by the following claims.

Thus having disclosed this invention, what is claimed is:

1. An electrophotographic printer having a front, rear, top, bottom, sides, print media collection tray, laser printer, fuser having a pressure activation/deactivation mechanism, toner cartridge and media path, the pressure activation/deactivation mechanism including a lever arm that is forced into an operating position by contact with the toner cartridge, and wherein the toner cartridge is inserted into/withdrawn from said printer via its top and wherein the pressure activation/deactivation mechanism is activated/deactivated by insertion/withdrawal of the toner cartridge into/out of said printer.

2. The electrophotographic printer of claim 1 wherein the fuser has a heater roller and a driven backup roller.

3. The electrophotographic printer of claim 1 wherein the pressure activation/deactivation mechanism has a lever arm that is forced upward by insertion of the toner cartridge into the printer and thereby placing the fuser in a pressured state.

4. The electrophotographic printer of claim 1 wherein the pressure activation/deactivation mechanism has a lever arm that, upon removal of the toner cartridge, is pulled downward by a biasing device and thereby placing the fuser in an unpressured state.

5. The electrophotographic printer of claim 1 wherein the pressure activation/deactivation mechanism includes a lever arm attached to a rotatable cam having a camming surface that is cammed against a journal in which a fuser roller resides and thereby placing the fuser in a pressured state.

6. The electrophotographic printer of claim 1 wherein said printer further comprises a sheet guide device located in front of the fuser and activated/deactivated by insertion/removal of the toner cartridge.

7. The electrophotographic printer of claim 1 wherein the print media collection tray is located on the top of the printer.

8. The electrophotographic printer of claim 1 wherein the print media collection tray is a portion of a pivotally mounted access door in the top of the printer.

9. The electrophotographic printer of claim 1 wherein said printer further comprises a fuser access door located in the printer.

10. The electrophotographic printer of claim 1 wherein said printer further comprises a second media path wherein print media is subjected to duplex printing.

11. The electrophotographic printer of claim 1 wherein said printer further comprises a print media feed tray located on the front of the printer.

12. The electrophotographic printer of claim 1 wherein said printer further comprises an envelope feed tray located on the front of the printer.

13. A fuser for an electrophotographic printer, said fuser comprising:

a heater roller connected to a first roller journal;

a backup roller connected to a second roller journal; and a cam having a cam surface and a lever arm that is deactivated/actuated by a toner cartridge that is taken out of/placed in contact with the lever when said toner cartridge is removed from/inserted into said printer.

14. The fuser of claim 13, wherein the backup roller is released from pressured contact with the heater roller by virtue of the lever arm being pulled downward by a biasing device when the toner cartridge is removed from the printer.

15. The fuser of claim 13, wherein the backup roller is placed in pressured contact with the heater roller by virtue of the lever arm being forced upward when the toner cartridge is inserted into the printer.

16. The fuser of claim 13 wherein the cam has a camming surface that is cammed against a journal in which a fuser roller resides and thereby placing the fuser in a pressured state.

17. The fuser of claim 13 wherein the cam has a camming surface that is cammed against a journal in which a backup roller resides and thereby placing the fuser in a pressured state.

18. The fuser of claim 13, wherein the lever arm is pulled downward by a biasing device and thereby placing the fuser in an unpressured state.

19. An electrophotographic printer having a front, rear, top, bottom, sides, print media collection tray, laser printer, fuser having a pressure activation/deactivation mechanism operated by insertion/removal of a toner cartridge, toner cartridge and media path, and wherein:

(1) the fuser can be accessed by removal of the toner cartridge via the top of said printer, (2) a fuser heater roller is positioned above a backup roller, (3) the backup roller is connected to a cammable roller journal; and (4) a cam having a cam surface that cams against/does not cam against the cammable roller journal when a lever arm is actuated by a toner cartridge that is taken out of/placed in contact with the lever when said toner cartridge is removed from/inserted into said printer.

* * * * *